United States Patent [19]

Spencer

[11] 4,022,562

[45] May 10, 1977

[54] PRESS HAVING TORQUE RESPONSIVE DRIVE

[75] Inventor: Robert Spencer, Stroud, England

[73] Assignee: Simon-Barron Limited, Gloucester, England

[22] Filed: Oct. 2, 1975

[21] Appl. No.: 619,008

[30] Foreign Application Priority Data

Nov. 9, 1974 United Kingdom ..... 48587/74

[52] U.S. Cl. ..... 425/331; 425/365; 425/DIG. 230

[51] Int. Cl.[2] ..... B28B 21/24

[58] Field of Search ..... 425/331, 311, 363, 365, 425/374, DIG. 230; 403/335, 336, 338, 356, 358; 64/12, 19, 24

[56] References Cited

UNITED STATES PATENTS

| | | | |
|---|---|---|---|
| 435,600 | 9/1890 | Cornwell | 403/356 X |
| 939,829 | 11/1909 | Grundy | 403/336 X |
| 1,233,171 | 7/1917 | Berry | 403/336 X |
| 3,010,150 | 11/1961 | Meakin | 425/331 |
| 3,039,797 | 6/1962 | Harper et al. | 403/336 X |
| 3,108,055 | 10/1963 | Grant | 425/331 X |
| 3,382,818 | 5/1968 | Landers | 425/331 |

*Primary Examiner*—Richard B. Lazarus
*Attorney, Agent, or Firm*—Norris & Bateman

[57] ABSTRACT

A press of the kind for the preparation of pellets of cattle feed or other pelletizable material and comprising an annular die having a plurality of radial bores therein, which is mounted on a driving rim for rotation around a stationary support fitted with a number of pressure rollers, each freely rotatable on a stationary shaft and in closely spaced relationship with the interior surface of the die, the arrangement being such that material fed into the interior of the die is forced through the bores therein by the action of said pressure rollers, characterized in that the die and driving rim therefor are provided with complementary circumferential mating male and female frusto-conical surfaces, there being wedge means on one part engagable with ramp means on the other part such that transmission of torque from the driving rim to the die causes said ramp and wedge means to cooperate to bring said mating surfaces into pressurized engagement.

12 Claims, 3 Drawing Figures

PRESS HAVING TORQUE RESPONSIVE DRIVE

This invention concerns a press of the kind (hereinafter termed of the kind referred to) for the preparation of pellets of cattle feed or other pelletizable material and comprising an annular die having a plurality of radial bores therein, which is mounted on a driving rim for rotation around a stationary support fitted with a number of pressure rollers, each freely rotatable on a stationary shaft and in closely spaced relationship with the interior surface of the die, the arrangement being such that material fed into the interior of the die is forced through the bores therein by the action of said pressure rollers.

In conventional presses of the kind referred to the annular die is secured to the driving rim by bolts which extend in a direction parallel with the central axis of the die or is secured by a bolted circumferential clamp.

It will thus be understood that it is necessarily a tedious and time consuming operation to remove and replace a die on the press for cleaning, maintenance or other purposes.

It is an object of the present invention to provide a press of the kind referred to wherein the means for securing the die to the driving rim therefor are such as to permit more ready removal and replacement of the die.

Thus, according to the present invention, a press of the kind referred to is characterised in that the die and driving rim therefor are provided with complementary circumferential mating male and female frusto-conical surfaces, there being wedge means on one part engageble with ramp means on the other part such that transmission of torque from the driving rim to the die causes said ramp and wedge means to cooperate to bring said mating surfaces into pressurised engagement.

The invention will be further apparent from the following description with reference to the figures of the accompanying drawings which show, by way of example only, one form of press of the kind referred to and embodying the invention.

Figure 3:
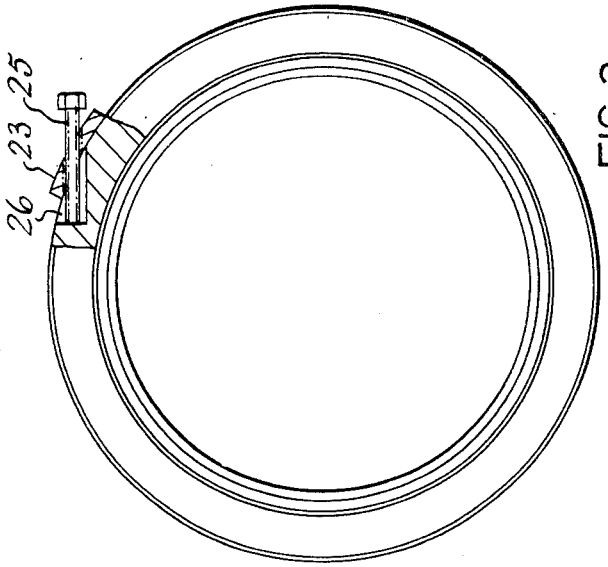
Figure 1:
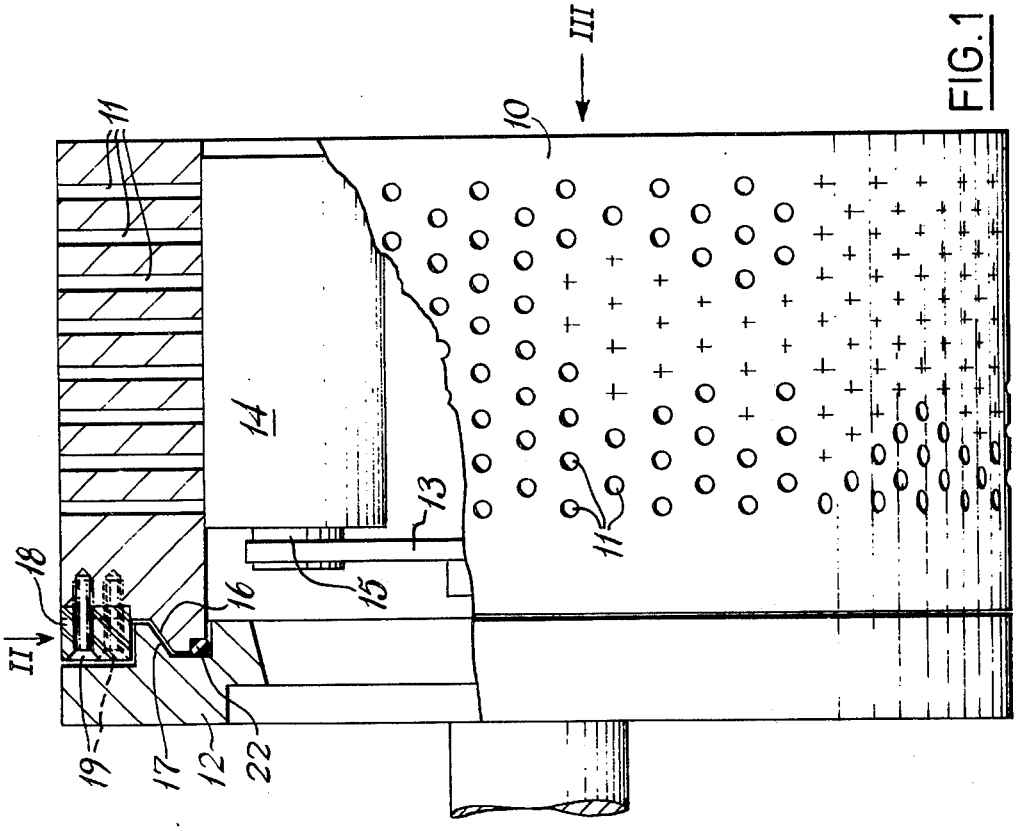
FIG. 1 shows a partially sectioned perspective and diagrammatic view of the press.

and FIG. 3 shows a partially sectioned end view of the press seen in the direction of the arrow III on FIG. 1.

Referring now to the drawing, it will be seen that the press, in known manner, essentially comprises an annular die 10 having a multiplicity of radial bores 11 therethrough, and which is arranged and its central axis extending in a horizontal direction. The die 10 is secured by one of its ends to annular driving rim 13 for rotation about a stationary support 13 disposed within the interior of the die 10. The stationary support 13 carries a number (usually two) of equi-angularly spaced pressure rollers 14, each freely rotatable about a stationary shaft 15 such that its periphery is closely spaced from the interior peripheral surface of the die 10.

In use material, such as cattle feed for example, which is to be pelletize is fed to the interior of the die 10 whilst the latter is rotated. The pressure rollers 14 force such material through the bores 11 and the material extruded through the die to the outside surface thereof is severed by knife means (not shown) to form pellets of the required length.

In accordance with the invention, the die 10 and driving rim 12 are formed with mating male and female frusto-conical surfaces 16 and 17 respectively, which extend circumferentially around the opposed end faces of the die 10 and driving rim 12. The rim and die members rotate about a central horizontal axis and surfaces 16 and 17 are axially facing.

Figure 2:
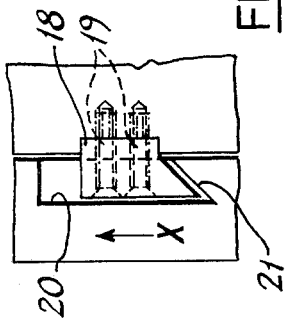
FIG. 2 shows a fragmentary view of the press seen in the direction of the arrow II on FIG. 1.

The end face of the die 10 which is directed towards the driving rim 12 has a plurality of wedge members 18 secured thereto by screws 19 at angularly spaced intervals around its periphery. Each wedge member 18 is adapted to be located in a complementary recess 20 in the face of the driving rim 12 which is directed toward the die 10. Each recess 20 includes a ramp portion 21 on which the wedge member 18 can slide. Ramp 21 and 18 engage in an inclined plane that as shown in FIG. 2 is at an angle to the axis of rotation of the die.

A bracket member 23 is secured by screws (not shown) to the driving rim 12 and extends axially to overlie the periphery of the die 10. A screw 25 is threadedly connected with a bore 24 in the bracket 23 such that its lower end engages an abutment defined by a wall of a recess 26 in the die 10.

In use, a die 10 is positioned on the driving rim 12 such that the mating male and female surfaces 16 and 17 are engaged, with the wedge members 18 located in their recesses 20. The screw 25 is then tightened to cause slight rotational movement of the die 10 relative to the driving rim 12 such that the wedge members 18 and ramps 21 cooperate to force the surfaces 16 and 17 together.

The arrangement is such that rotation of the driving rim 12 (which occurs in the direction of the arrow X on FIG. 2) is such as to cause the mating surfaces 16 and 17 to be drawn into pressurised engagement by the action of the wedge members 18 and ramps 21.

It will be understood that torque is transmitted from the driving rim 12 to the die 10 by friction at the surfaces 16 and 17, and further that the greater the load applied to the die 10, the greater the tendency of the surfaces 16 and 17 to be forced together, thus to be capable of transmitting the required torque.

It will be understood that the wedge members 18 and recesses 20 are so designed that sliding movement of the wedges over the ramps is not arrested by abutment of the wedge means 18 with the bottoms of the recesses 20.

A resilient ring 22 is provided between the parts 10 and 12 to form a seal.

It will be appreciated that it is not intended to limit the invention to the above example only, many variations, such as might readily occur to one skilled in the art, being possible without departing from the scope thereof.

Thus, the male and female conical mating surfaces may be provided on the driving rim and annular die respectively instead of on the annular die and driving rim as shown in FIG. 1 of the accompanying drawings.

Again, for example, the wedge members 18 may be secured to the driving rim and adapted for location in complementary recesses formed with ramps in the end face of the annular die.

What is claimed is:

1. A press for pelletization of material comprising an annular die member having a plurality of radial bores therethrough, a stationary support disposed within said die, a plurality of pressure rollers arranged in a row around the inner circumferential surface of said die member, said rollers being freely rotatable about fixed parallel axes and with the radially outer surface of each roller closely adjacent the inner surface of said die member, a driving rim member mounted for rotation about a central axis parallel to said roller axes, and means mounting said die member on said rim member comprising interfitting coextensive complementary axially oppositely facing frusto-conical male and female surfaces and coacting means on said rim member and the adjacent end of said die member for attaching said die and rim member together and urging said frusto-conical surfaces into pressurized engagement comprising wedge and ramp means on said members distinct from said frusto-conical surfaces and engaging in one or more inclined planes disposed at an angle to said central axis whereby transmission to torgue from said rim member to said die member acts through said wedge and ramp means to relatively axially urge said frusto-conical surfaces into increased pressurized engagement, rotation of said rim member rotating said die member about said central axis so that material fed into the interior of the die member is forced out through the die member bores by action of said pressure rollers.

2. A press according to claim 1 wherein said male and female frusto-conical surfaces are provided on the annular die and driving rim members respectively.

3. A press according to claim 1 wherein said female and male frusto-conical surfaces are provided on the annular die and driving rim respectively.

4. A press according to claim 1 wherein said wedge means is comprised by a plurality of wedge elements secured to one of said annular die and driving rim members which elements are located in complementary recesses on the other of said members, each recess including a ramp portion on which its associated wedge element can slide.

5. A press according to claim 2 wherein said wedge means is comprised by a plurality of wedge elements secured to one of said annular die and driving rim members which elements are located in complementary recesses on the other of said members, each recess including a ramp portion on which its associated wedge element can slide.

6. A press according to claim 3 wherein said wedge means is comprised by a plurality of wedge elements secured to one of said annular die and driving rim members which elements are located in complementary recesses on the other of said members, each recess including a ramp portion on which its associated wedge element can slide.

7. A press according to claim 1 wherein a rotatably adjustable screw is mounted on one of said annular die and driving rim members and located to engage an abutment on the other of said members whereby rotation of the screw causes relative rotational movement between the annular die and driving rim members to cause the wedge means to cooperate to draw said frusto-conical surfaces together.

8. A press according to claim 2 wherein a rotatably adjustable screw is mounted on one of said annular die and driving rim members and located to engage an abutment on the other of said members whereby rotation of the screw causes relative rotational movement between the annular die and driving rim members to cause the wedge means to cooperate to draw said frusto-conical surfaces together.

9. A press according to claim 3 wherein a rotatably adjustable screw is mounted on one of said annular die and driving rim members and located to engage an abutment on the other of said members whereby rotation of the screw causes relative rotational movement between the annular die and driving rim members to cause the wedge means to cooperate to draw said frusto-conical surfaces together.

10. A press according to claim 4 wherein a rotatably adjustable screw is mounted on one of said annular die and driving rim members and to engage an abutment on the other of said members whereby rotation of the screw causes relative rotational movement between the annular die and driving rim members to cause the wedge means to cooperate to draw said frusto-conical surfaces together.

11. A press according to claim 5 wherein a rotatably adjustable screw is mounted on one of said annular die and driving rim members and located to engage an abutment on the other of said whereby rotation of the screw causes relative rotational movement between the annular die and driving rim members to cause the wedge means to cooperate to draw said frusto-conical surfaces together.

12. A press according to claim 6 wherein a rotatably adjustable screw is mounted on one of said annular die and driving rim members and located to engage an abutment on the other of said members whereby rotation of the screw causes relative rotational movement between the annular die and driving rim members to cause the wedge means to cooperate to draw said frusto-conical surfaces together.

* * * * *

UNITED STATES PATENT OFFICE

CERTIFICATE OF CORRECTION

Patent No. 4,022,562 Dated May 10, 1977

Inventor(s) Robert Spencer

It is certified that error appears in the above-identified patent and that said Letters Patent are hereby corrected as shown below:

Column 1, line 54 change "and" (second occurence) to --with--.

Column 1, line 56 change "13" to --12--.

Column 4, line 38 claim 11, add "members" after --said--.

Signed and Sealed this second Day of August 1977

[SEAL]

*Attest:*

RUTH C. MASON
*Attesting Officer*

C. MARSHALL DANN
*Commissioner of Patents and Trademarks*